United States Patent [19]

Yi

[11] 4,080,683

[45] Mar. 28, 1978

[54] CHALK BOARD ERASER

[75] Inventor: Chong Sun Yi, 1232 North Britain Rd., Apt. 132, Irving, Tex. 75061

[21] Appl. No.: 743,909

[22] Filed: Nov. 22, 1976

[51] Int. Cl.[2] ..... A47L 11/04

[52] U.S. Cl. ..... 15/98; 15/121; 15/48

[58] Field of Search ..... 15/221, 98, 48, 27, 15/3.53, 219, 210.5, 230.11 X; 35/62

[56] References Cited

U.S. PATENT DOCUMENTS

| | | | |
|---|---|---|---|
| 602,266 | 4/1898 | Peck | 15/27 |
| 1,487,052 | 3/1924 | Enomoto | 15/210 R |
| 2,026,414 | 12/1935 | Burch | 15/48 |

*Primary Examiner*—Harvey C. Hornsby
*Assistant Examiner*—Timothy F. Simone
*Attorney, Agent, or Firm*—Hubbard, Thurman, Turner, Tucker & Glaser

[57] ABSTRACT

A self-cleaning hand-held chalk board eraser is disclosed which includes a chalk trough for catching and collecting the loose chalk from a chalkboard, a roller, the outer surface of which is made of suitable chalk-erasing material, and a brush mounted in the eraser to remove the loose chalk from the roller material in such a way that the loose chalk becomes trapped in the chalk trough.

9 Claims, 6 Drawing Figures

CHALK BOARD ERASER

This invention relates to chalkboard erasers and in one of its aspects to a hand-held, self-cleaning chalkboard eraser.

In the past, most chalkboard erasers were not self-cleaning, but were simply erasing material (generally made of fabric) mounted on a backing which functioned as a handle. The eraser could be used until the erasing material was saturated with chalk dust, at which time it had to be abandoned until it had been cleaned. Besides making it necessary to keep a supply of clean erasers available, each eraser left the chalkboard progressively chalkier and less useable as the chalk built up in the erasing material. Both of these problems can be avoided by an eraser that cleans the erasing material while it is being used.

A self-cleaning chalk eraser was developed by the inventor of the chalkboard eraser of this application, Chong Sun Yi, and is evidenced by Korean Utility Model Application No. 1574/74. The invention of that application embodied the concept of using an erasing roller to remove chalk from a chalkboard. The erasing roller was mounted in a case which also functioned as a handle and included a chalk trough for catching the loose chalk which was removed from the erasing roller by a second roller.

A major problem was that the second roller did not satisfactorily remove the chalk from the first roller since both rollers could become chalkbound. Since both rollers were essentially of the same construction, both were chalkdust absorbing. When the short bristles of the second roller would become clogged with chalk dust, it would not provide an efficient cleaning action for removing chalk from the first roller.

A second problem of the referred to eraser was that loose chalk dust that had been removed from the first roller could inadvertently fall out of the eraser onto the floor or onto the person using the eraser rather than being trapped in the chalk trough until purposely emptied. The chalk dust could also escape to the air and be a health hazard. This could occur because loose chalk would fall past the ends of the roller to the roller channel, and from the roller channel, the loose chalk would fall out of the eraser onto the floor.

In accordance with the preferred embodiment of the invention, an erasing roller is mounted on a hollow case which catches the loose chalk that is removed from the roller. The chalk is removed from the roller by a brush which is mounted in the case so that its bristles engage the roller. The newly loosened chalk is guided into chalk troughs formed by the case and is prevented from falling past the ends of the roller by chalk baffles integral with the case. In another embodiment, the brush is replaced by scraping edges attached to the case which longitudinally engage the roller whereby chalk is removed from the roller by the scraping edges as the roller revolves.

DESCRIPTION OF THE DRAWINGS

A more complete understanding of the invention may be had by referring to the following detailed description when taken in conjunction with the accompanying drawings, wherein.

Figure 1:
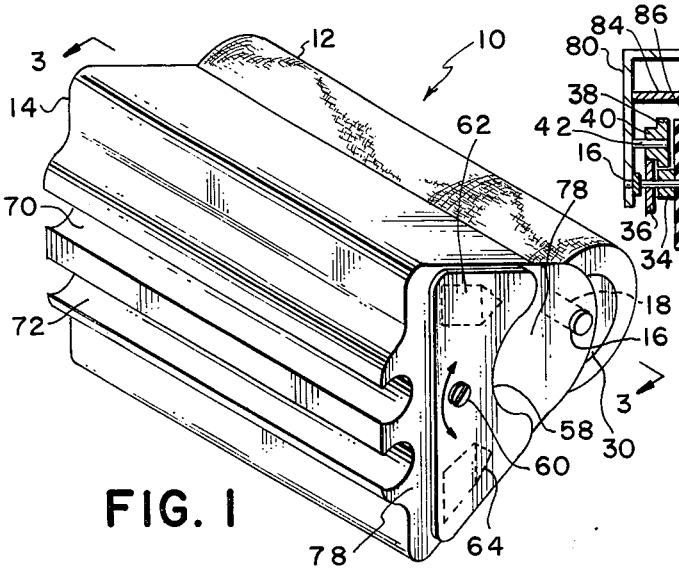
FIG. 1 is a perspective view in elevation of a chalkboard eraser employing the invention looking at the bottom and one end thereof.

Referring now to the drawings, a chalkboard eraser in accordance with the present invention is indicated generally by reference numeral 10 in FIG. 1. The chalkboard eraser 10 includes an erasing roller 12 and a case 14 which may be made of plastic or other suitable material. Case 14 has a hole 16 at each end for rotatably supporting an axle 18. Case 14 is shaped so it may be easily gripped and hand-held from the side opposite the erasing roller so that roller 12 can be pressed against a chalkboard for the erasing operation. When roller 12 is pressed against the chalkboard and force is applied to the eraser in a direction parallel to the face of the chalkboard and substantially perpendicular to axle 18, the roller rolls, and slides on the chalkboard, removing unwanted chalk from the board. Since the roller turns during this operation, the whole erasing surface of roller 12 is eventually exposed and utilized in the erasing operation.

Figure 3:
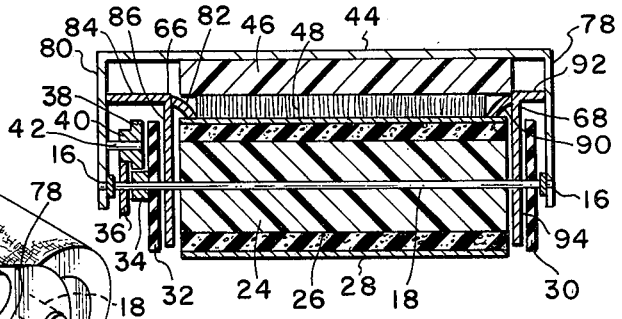
FIG. 3 is a sectional view taken along lines 3—3 of FIG. 1.
Figure 4:
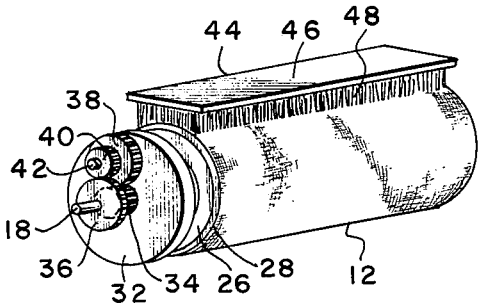
FIG. 4 is a perspective view of a roller, brush and gears of a chalkboard eraser of the present invention shown removed from the case.
Figure 2:
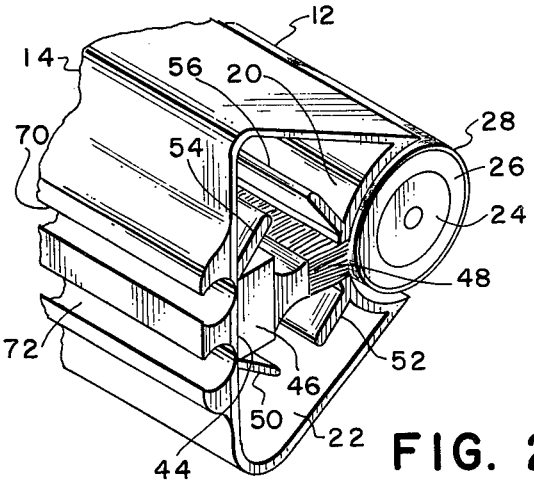
FIG. 2 is a view of the chalkboard eraser similar to FIG. 1 in cutaway to show the interior thereof.

Roller 12 comprises a hard inner core 24 surrounded by a resilient cylinder 26 made of a multicellular rubbery polymer or any other suitably resilient material and a chalk erasing material 28 such as felt, as seen in FIG. 2. The construction of roller 12 is such that when pressed firmly against the chalkboard, resilient cylinder 26 flattens against the chalkboard, thus providing a working surface of chalk erasing material 28 which removes chalk from the chalkboard. At one end of the roller, mounted rotatably on axle 18, is a disc 30 and on the other end, a disc 32, as seen in FIG. 3. Disc 30 and disc 32 are made of a hard material such as hard rubber and are larger in diameter than the hard inner core 24 of roller 12 and are smaller in diameter than the outer diameter of the resilient cylinder 26. Disc 30 and disc 32 thus prevent resilient cylinder 26 from being flattened against a chalkboard so much that roller 12 is unduly restricted from revolving.

A disc gear 34 is mounted on axle 18 in fixed relationship to disc 32 as shown in FIG. 3. A first step-down gear 38 meshes with smaller disc gear 34 so that step-down gear 38 revolves at a slower rate than disc gear 34. A second step-down gear 40 revolves in a fixed relationship with first step-down gear 38. Second step-down gear 40 meshes with a larger roller gear 36 which turns in a fixed relationship with roller 12.

Gears 34, 36, 38 and 40 operate as a means for slowing the rotational speed of roller 12 to a slower rate than disc 32, thus providing the needed sliding between chalk erasing material 28 and the chalkboard since disc 32 is less likely to slide against the chalkboard than is chalk erasing material 28 backed by resilient cylinder 26. Gears 34, 36, 38 and 40 further operate to ensure that roller 12 does turn when the eraser is in use and does not become stuck, preventing erasing material 28 from being cleaned. Disc 32 is joined in a fixed relationship to spur gear 34. The combination disc 32 and disc gear 34 can rotate with respect to the axle 18, as can the single disc 30. Axle gear 36 is mounted on axle 18, in a fixed relationship so that, in combination, gear 36 and axle 18 transmit the torque from gear 34, which revolves at the same rate as disc 32, to roller 12. Axle 42 is in a fixed relationship to case 14 in this embodiment, for stability. The result of the gear system is to step down the rotational speed of disc 32 twice before transmitting to roller 12, once by gear 34 to gear 38 and once by gear 40 to gear 36, thus providing a means for slowing the rotational speed of the roller so that there is sliding between the roller and the chalkboard when the eraser is moved across the chalkboard in a direction transverse to the roller axis.

The walls of case 14 form longitudinally extending chalk troughs 20 and 22. A brush 44, longitudinally mounted in case 14 and including a base 46 and bristles 48, brushes loose chalk from roller 12 as roller 12 revolves. Longitudinally extending lips 50 and 52 funnel loose chalk into trough 22 when the eraser is held so that the lips are above the trough and prevent the chalk from falling out of the trough when the eraser is held so that the lips are below the trough. Lips 54 and 56 are longitudinally disposed along the opening of chalk trough 20 and funnel loose chalk into trough 20 when the eraser is held so that the lips are above the trough and prevent the chalk that is in the trough from falling out when the eraser is held so that the lips are below the trough. Thus, as chalk is removed from the chalkboard by chalk erasing material 28 on one side of roller 12, loose chalk is removed from chalk erasing material 28 on the other side of roller 12 by bristles 48 of brush 44. As chalk is removed from roller 12 by bristles 48, it falls into the lower chalk trough, into trough 22 as shown in FIG. 2.

Case 14 further comprises an end wall 78 substantially perpendicular to longitudinally extending troughs 20 and 22, which includes an aperture 62 and an aperture 64. A plate 58 is pivotally mounted onto wall 78 by screw 60 so that, in its normal working position, it covers both aperture 62 and aperture 64, preventing chalk from spilling through the apertures from trough 20 or trough 22 since without plate 58 attached, longitudinally extending trough 20 is in open communication with the environment of case 14 through aperture 62 and longitudinally extending trough 22 is in open communication with the environment of case 14 through aperture 64. Plate 58 can be pivoted one way in order to remove loose chalk from trough 20 through aperture 62 and then pivoted in the opposite direction in order to remove loose chalk from trough 22 through aperture 64. Case 14 also comprises an end wall 80 which is substantially perpendicular to longitudinally extending troughs 20 and 22 and forms the end of case 14 opposite wall 78.

Figure 5:
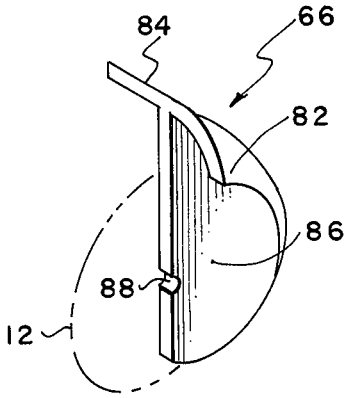
FIG. 5 is a perspective view in elevation and cutaway of a chalk baffle of this invention with one end of a roller of of this invention shown in phantom lines.

Case 14 also includes a chalk baffle 66 which can be seen in FIG. 3, which extends from wall 80 to circumferentially engage the end of roller 12 nearest disc 32 to prevent the loose chalk removed from roller 12 by brush 44 from falling outside of case 14 by slipping past disc 32 end of roller 12. Chalk baffle 66 comprises a roller engaging portion 82 to prevent the loose chalk from falling past the end of the roller, as can be more clearly seen in FIG. 5, and to structural support elements 84 and 86. Element 84 attaches to wall 80, and wall 86 is supported by axle 18 which passes through hole 88. Chalk baffle 68 is of similar construction comprising roller engaging portion 90, and support elements 92 and 94. Case 14 also includes a chalk baffle 68 at disc 30 end of roller 12 which extends from wall 78 to circumferentially engage the end of roller 12 thus preventing loose chalk from spilling past the end of roller 12.

Slots 70 and 72 are also provided in case 14 along the hand-held portion of the case parallel to roller 12, as seen in FIG. 1 and FIG. 2, for retaining sticks of chalk. Sticks of chalk can be slipped into slots 70 and 72 when they are not in use, thus providing easy access to the extra pieces of chalk by the person using the self-cleaning eraser.

Figure 6:
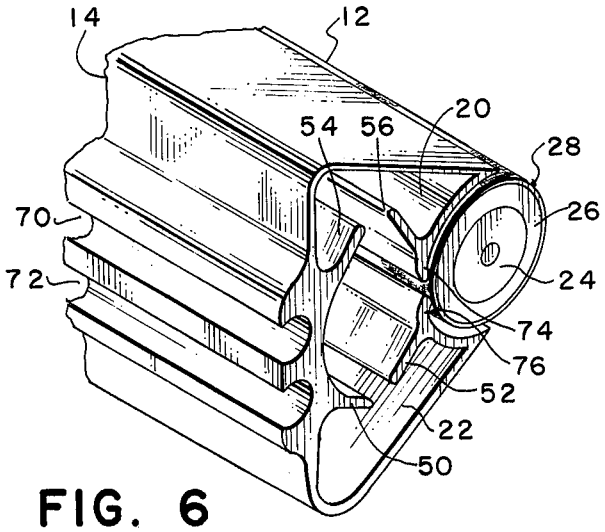
FIG. 6 is a view similar to FIG. 2 of a different embodiment of the invention.

In another embodiment of the present invention, brush 44 is replaced by longitudinally extending scraping edges 74 and 76, as shown in FIG. 6. Scraping edge 74 and scraping edge 76 engage roller 12 as it revolves, knocking loose chalk from erasing material 28.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A hand-held self cleaning chalkboard eraser comprising, in combination:
   - a case;
   - a roller rotatably mounted in the case and including an outer surface made of a chalk erasing material for removing chalk from the chalkboard;
   - a stationary means mounted in the case for engaging the erasing material of the roller whereby loose chalk is removed from the erasing material as the roller rotates with respect to the case; and wherein said means does not absorb chalk at the engaging surface;
   - at least one chalk trough for storage of loose chalk removed from the chalkboard situated to receive the loose chalk as it is removed from the erasing material; and
   - step-down gearing means connected to said roller for slowing the rotation of the roller as it is moved along the surface of a chalkboard so that there is sliding between the roller and the chalkboard when the eraser is moved across the chalkboard in a direction transverse to the roller axis.

2. A self-cleaning chalkboard eraser according to claim 1 wherein the means for engaging the erasing material is a brush having a plurality of bristles that engage the erasing material.

3. A self-cleaning chalkboard eraser according to claim 2 wherein the roller also includes a cylinder of resilient material surrounding a hard inner core; and
   - said means for slowing the rotation of the roller includes two discs rotatably mounted in the case, one of the discs at each end of the roller, the discs being larger in diameter than the hard inner core and smaller in diameter than the outer diameter of the resilient cylinder and substantially less resilient than the resilient cylinder and further includes a means for slowing the rotation of the roller with respect to that of the discs whereby when the discs roll on the chalkboard, the roller both rolls and slides on the chalkboard.

4. A self-cleaning chalkboard eraser according to claim 3 wherein the means for slowing the rotation of the roller with respect to that of the discs includes:

a first gear mounted in the case for rotating in fixed relationship with the roller;

a second gear mounted for rotating in fixed relationship to one of the two discs; and means including at least one gear mounted in the case for transmitting torque from the second gear to the first gear and rotating the first gear at a slower rate than the second gear.

5. A self-cleaning chalkboard eraser according to claim 4 further comprising:

two chalk baffles oppositely disposed at the two ends of the case and extending from the ends of the case to the roller and circumferentially engaging the roller near the ends of the roller for preventing loose chalk from spilling out of the case.

6. A self-cleaning chalkboard eraser according to claim 1 wherein the means for engaging the erasing material is at least one longitudinally extending scrapping edge.

7. A self-cleaning chalkboard eraser according to claim 6 wherein the roller also includes a cylinder resilient material surrounding a hard inner core; and the means for slowing the rotation of the roller so that there is sliding between the roller and the chalkboard includes two discs rotatably mounted in the case, one of the discs at each end of the roller, the discs being larger in diameter than the hard inner core and smaller in diameter than the outer diameter of the resilient cylinder and substantially less resilient than the resilient cylinder and further includes a means for slowing the rotation of the roller with respect to that of the discs whereby when the discs roll on the chalkboard, the roller both rolls and slides on the chalkboard.

8. A self-cleaning chalkboard eraser according to claim 7 wherein the means for slowing the rotation of the roller with respect to that of the discs includes:

a first gear mounted in the case for rotating the fixed relationship with the roller;

a second gear mounted in the case for rotating in fixed relationship to one of the two discs; and means including at least one gear mounted in the case for transmitting torque from the second gear to the first gear and rotating the first gear at a slower rate than the second gear.

9. A self-cleaning chalkboard eraser according to claim 8 further comprising:

two chalk baffles oppositely disposed at the two ends of the case and extending from the ends of the case to the roller and circumferentially engaging the roller near the ends of the roller for preventing loose chalk from spilling out of the case.

* * * * *